United States Patent [19]

Ishida et al.

[11] 4,084,849

[45] Apr. 18, 1978

[54] BABY CHAIR AND BED

[75] Inventors: Hajime Ishida; Mitsuyo Tsumita, both of Tokyo, Japan

[73] Assignee: Tomy Kogyo Co., Inc., Tokyo, Japan

[21] Appl. No.: 726,231

[22] Filed: Sep. 24, 1976

[30] Foreign Application Priority Data

Nov. 15, 1975 Japan ..... 50-155262

[51] Int. Cl.[2] ..... A47C 1/034

[52] U.S. Cl. ..... 297/22; 297/30; 297/377

[58] Field of Search ..... 297/21, 22, 39, 31, 297/30, 23, 19, 377, 323

[56] References Cited

U.S. PATENT DOCUMENTS

| | | | |
|---|---|---|---|
| 240,991 | 5/1881 | Fuller | 297/23 |
| 523,903 | 7/1894 | McPhee et al. | 297/377 X |
| 770,852 | 9/1904 | Grover | 297/19 X |
| 1,414,897 | 5/1922 | Reilly | 297/31 |
| 2,493,646 | 1/1950 | Schmidt | 297/22 |
| 3,649,074 | 3/1972 | McDonald et al. | 297/377 X |

FOREIGN PATENT DOCUMENTS

| | | | |
|---|---|---|---|
| 705,203 | 4/1941 | Germany | 297/377 |
| 2,417,532 | 10/1975 | Germany | 297/253 |
| 874,736 | 8/1961 | United Kingdom | 297/366 |

*Primary Examiner*—Francis K. Zugel
*Attorney, Agent, or Firm*—Staas & Halsey

[57] ABSTRACT

The present invention relates to a combination chair and bed for small children featuring a back and seat rotatably mounted to each other, a footrest rotatably mounted to the seat, a support rod having legs spaced apart from each other and an intermediate connecting portion, the ends of the leg portions being connected to the footrest permitting rotation therebetween, the legs also being connected to the back permitting rotation therebetween, a locking rod having ends and an intermediate portion, the ends of the locking rod being connected to the legs of the support rod permitting rotation therebetween, and a positioning and locking mechanism connecting the intermediate portion of the locking rod to the back at a plurality of predetermined positions therealong such that the back, seat and footrest may assume a flat position defining a bed, a collapsed position for carrying and storage, and a plurality of intermediate positions when functioning as a chair.

6 Claims, 8 Drawing Figures

FIG. 1
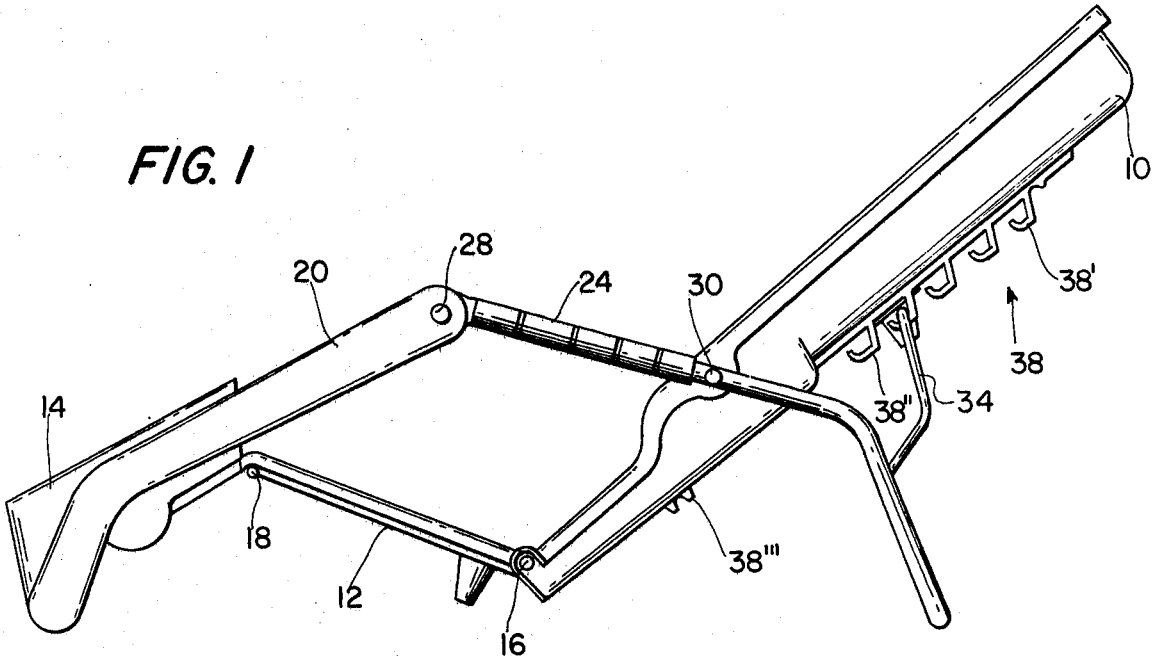
FIG. 6
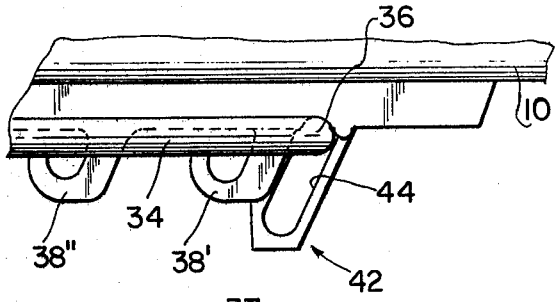
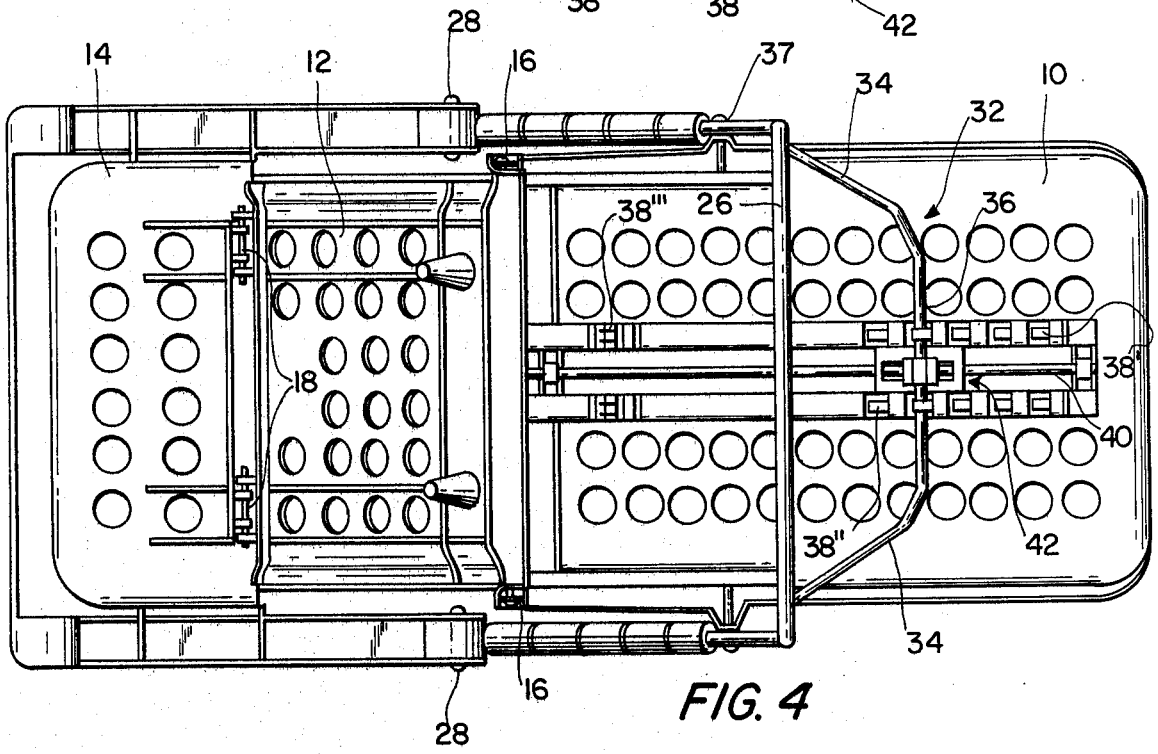
FIG. 4

BABY CHAIR AND BED

BACKGROUND AND SUMMARY OF THE INVENTION

The present invention relates to a combination chair and bed for small children and includes a back, seat and footrest that are suitably attached to each other such that adjacent of these elements may rotate with respect to each other. A support rod having leg portions spaced apart from each other and an intermediate connecting portion is operatively connected to the back and footrest, and a locking rod is operatively connected to the support rod and to the back such that as the intermediate portion of the locking rod is moved between a plurality of locking positions along the back, the back, seat and footrest assume a variety of different positions, including a position wherein these elements are aligned with each other so as to define a bed, another position wherein these elements are folded or collapsed for storage or carrying, and several additional, intermediate positions wherein these elements are arranged at varying angles to each other to define a variety of sitting positions.

BRIEF DESCRIPTION OF THE DRAWINGS

FIG. 1 is a side elevational view of the combination chain and bed in one of the intermediate sitting positions;

FIG. 4 is a bottom plan view of the combination chair and bed wherein the back, seat and footrest are aligned in such a manner so as to define a bed;

FIG. 6 is an enlarged fragmentary side elevational view showing the construction of the positioning and locking mechanism which connects the locking rod to the back at a plurality of predetermined positions.

DESCRIPTION OF THE PREFERRED EMBODIMENT

Figure 2:
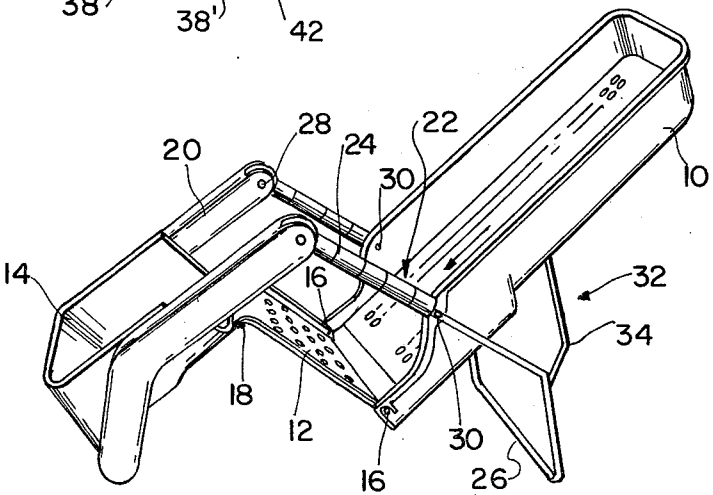
FIG. 2 is a perspective view of the combination chair and bed in one of the intermediate sitting positions.

As illustrated in FIGS. 1 and 2, the combination chair and bed of the present invention consists of a back 10, seat 12, and footrest 14. Shafts 16 operatively connect the back 10, and the seat 12, permitting the back 10 and the seat 12 to rotate with respect to each other. In like manner, shafts 18 operatively connect the seat 12 and the footrest 14 permitting these elements to rotate with respect to each other.

The footrest 14 is provided on each side thereof with upstanding arms 20. A support rod designated generally by the reference numeral 22 in FIGS. 1 and 2 consists of two leg portions 24 that are spaced apart from each other and an intermediate connecting portion 26. As will be further apparent from FIG. 2, the shafts 28 operatively connect the ends of the legs 24 to the arms 20 of the footrest 14 permitting the footrest 14 to rotate relative to the leg portions 24. In similar manner, the shafts 30 operatively connect the leg portions 24 to the back 10 permitting the back 10 to rotate relative to the leg portions 24.

A locking rod designated generally by the reference numeral 32 consists of ends 34 and an intermediate portion 36. The ends 34 of the locking rod 32 are mounted within openings 37 provided within the leg portions 24 permitting the locking rod 32 to rotate relative to the support rod 22.

As seen in FIGS. 1 and 4, there are provided on the back 10 a plurality of pairs of locking flanges designated generally by the reference numeral 38. It will be apparent from FIG. 4 that near the top of the back 10 there is provided a first pair of locking flanges 38' while at the lower end of the back 10 there is provided a second pair of locking flanges 38''. Intermediate the first and second flanges 38' and 38'' are positioned a plurality of third pairs of locking flanges designated by the reference numeral 38''', the purpose of which will be explained in detail hereinafter. Finally, a guide rod 40 is suitably mounted to extend along the back 10.

A positioning and locking member designated generally by the reference numeral 42 in FIG. 6 is mounted to slide along the guide rod 40. The locking member 42 is provided with a slotted portion 44 through which the intermediate portion 36 of the locking rod 32 extends. It will be apparent that as the intermediate portion 36 is moved downwardly within the slotted portion 42 it is possible to move the locking member 42 and the intermediate portion 36 up and down the back 10 along the rod 40. When it is desired to lock the back 10 in a particular position, the intermediate portion 36 is moved upwardly within the slotted portion 42 until the intermediate portion 36 is positioned within the desired pair of locking flanges 38.

Figure 3:
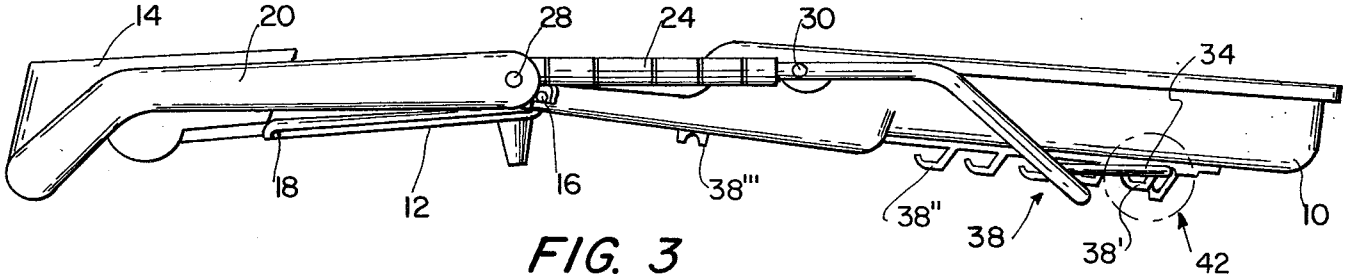
FIG. 3 is a side elevational view of the combination chair and bed with the back, seat, and footrest aligned to define a bed.
Figure 5:
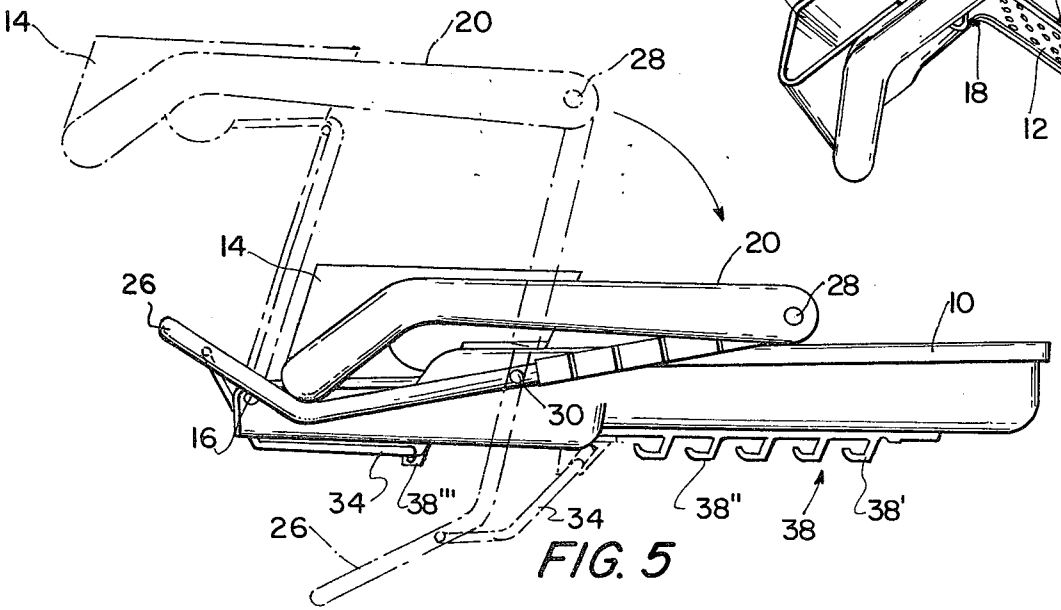
FIG. 5 is a side elevational view of the combination chair and bed showing the footrest and seat rotated to the fully closed position wherein carrying and storage is simplified, and the path of rotation of these elements from one of the intermediate sitting positions in phantom lines.
Figure 7:
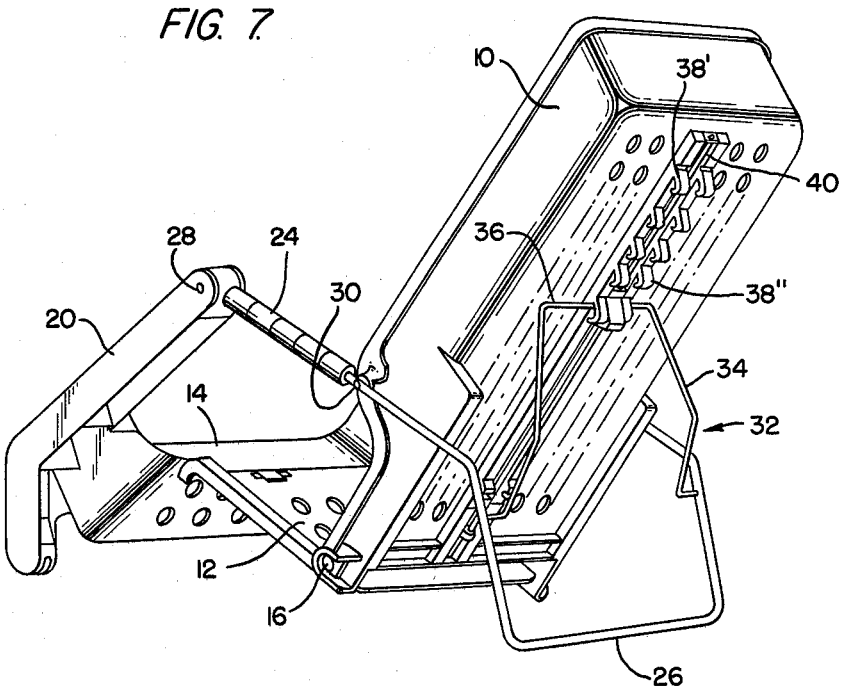
FIG. 7 is a perspective view from the rear thereof.
Figure 8:
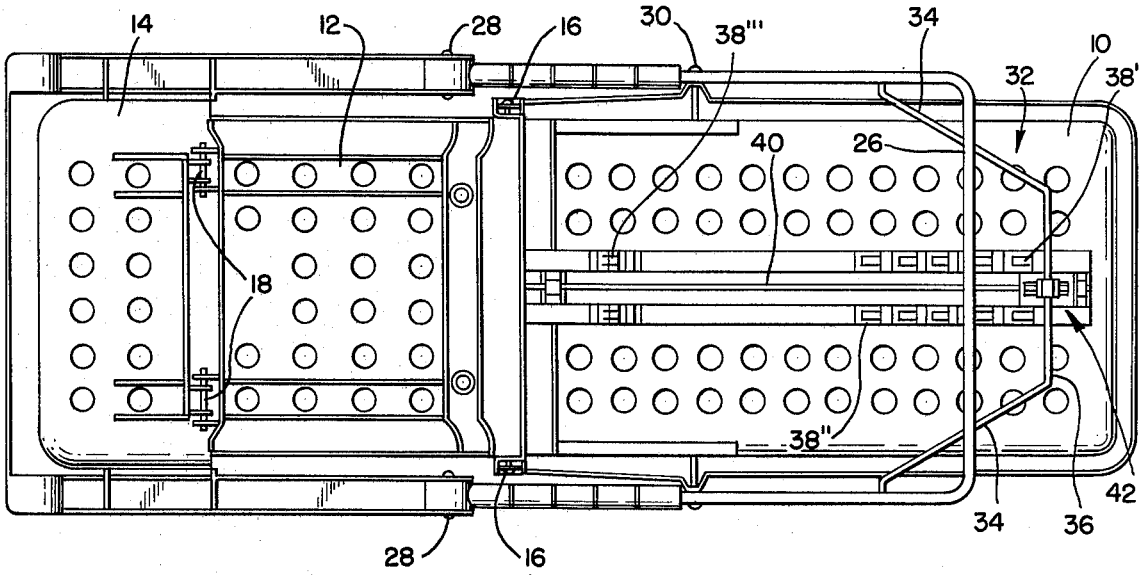
FIG. 8 is a bottom plan view of the combination chair and bed wherein the back, seat and footrest are aligned in a different position from that shown in FIG. 4.

It will be apparent from FIG. 3 that when the intermediate portion 36 of the locking rod 32 is positioned within the first pair of locking flanges 38', the back 10, seat 12 and footrest 14 assume a rectilinear position forming a bed. When the intermediate portion 36 of the locking rod 32 is positioned within the second pair of locking flanges 38'', as illustrated in solid lines in FIG. 5, the seat 12 and footrest 14 rotate into a folded position. In this position, the combination chair and bed is in collapsed position and may be carried, for example, by the intermediate connecting portion 26 of the support rod 22 or stored for use at a later date. It will also be apparent that as the intermediate portion 36 of the locking rod 32 is positioned within one of the remaining third pairs of locking flanges 38''', as illustrated in FIGS. 1–2, the seat 12 and footrest 14 are rotated to occupy different angular relationships and thus define different sitting positions. In these various sitting positions the intermediate portion 26 of the support rod 22 rests against the ground or other surface supporting the combination chair and bed.

We claim:

1. A combination chair and bed for children, comprising:

a back, a seat, means connecting said back and said seat permitting same to rotate with respect to each other, a footrest provided with arms on each side thereof, means connecting said seat and said footrest permitting same to rotate with respect to each other, a support rod having leg portions spaced apart from each other terminating in ends and an intermediate connecting portion, means connecting said ends of said leg portions of said support rod to said arms of said footrest permitting same to rotate with respect to each other, means connecting said leg portions of said support rod to said back permitting same to rotate with respect to each other, a locking rod having ends and an intermediate portion, means connecting said ends of said locking rod to said leg portions of said support rod permitting same to rotate with respect to each other, and means connecting said intermediate portion of said locking rod to said back at a plurality of positions along said back, all of said means cooperating so that the components thereof can substantially form a bed in one position thereof, substantially form a chair in another position thereof, and be collapsed for carrying and storage.

2. A combination chair and bed as in claim 1, wherein said means connecting said intermediate portion of said locking rod to said back comprises a plurality of pairs of locking flanges positioned along said back, each of said locking flanges extending outwardly from said back and position to support said intermediate portion of said locking rod, a guide mounted to said back and extending between said flanges of each of said pairs of flanges, a locking member mounted to slide along said guide and provided with a slotted portion through which said intermediate portion of said locking rod extends.

3. A combination chair and bed as in claim 1, wherein said means connecting said intermediate portion of said locking rod to said back at a plurality of positions along said back comprises a plurality of pairs of flanges positioned along said back including a first pair positioned generally near the top of said back such that when said intermediate portion of said locking rod is positioned within said first pair said back, seat and footrest form a generally straight line permitting the combination chair and bed to function as a bed, a second pair of flanges positioned generally near the bottom of said back such that when said intermediate portion of said locking rod is positioned within said second pair, said seat is rotated relative to said back and said footrest is rotated relative to said seat folding said seat and footrest collapsing the combination chair and bed, and a third pair of the locking flanges positioned intermediate said first and second pair such that when said intermediate portion of said locking rod is positioned within said third pair said seat is positioned at an angle to said back and said footrest is positioned at an angle to said seat to define a chair.

4. A combination chair and bed for children as in claim 1, wherein said back has top and side edges and is provided with a continuous wall extending outwarding from said top and side edges, and wherein said footrest has bottom and side edges and is provided with a continuous wall extending outwardly from said bottom and side edges.

5. A combination chair and bed as in claim 4, wherein said arms of said footrest are located on said continuous wall which extends outwardly from said side edges, said arms extending beyond said footrest.

6. A combination chair and bed as in claim 5, wherein said means connecting said ends of said leg portions of said support rod to said arms of said footrest comprise swivels fixedly secured to said ends and pins extending through the ends of said arms and said swivels permitting said swivels to rotate about the ends of said arms.

* * * * *